US012779316B2

(12) United States Patent
Huggins et al.

(10) Patent No.: US 12,779,316 B2
(45) Date of Patent: Nov. 3, 2026

(54) MAGNETIC BOWLING GAME

(71) Applicant: GameLife Sports, LLC, Hilton Head Island, SC (US)

(72) Inventors: Mark Huggins, Hilton Head Island, SC (US); Justin M. Spalding, Easley, SC (US)

(73) Assignee: GameLife Sports, LLC, Hilton Head Island, SC (US)

( * ) Notice: Subject to any disclaimer, the term of this patent is extended or adjusted under 35 U.S.C. 154(b) by 297 days.

(21) Appl. No.: 18/632,265

(22) Filed: Apr. 10, 2024

(65) Prior Publication Data

US 2024/0335731 A1 Oct. 10, 2024

Related U.S. Application Data

(60) Provisional application No. 63/458,404, filed on Apr. 10, 2023, provisional application No. 63/458,406, filed on Apr. 10, 2023.

(51) Int. Cl.

| | |
|---|---|
| ***A63D 1/00*** | (2006.01) |
| ***A63D 1/02*** | (2006.01) |
| ***A63D 1/04*** | (2006.01) |
| ***A63D 9/00*** | (2006.01) |

(52) U.S. Cl.
CPC ..... *A63D 1/04* (2013.01); *A63D 1/02* (2013.01); *A63D 9/00* (2013.01)

(58) Field of Classification Search
CPC ..... A63D 9/00
See application file for complete search history.

(56) References Cited

U.S. PATENT DOCUMENTS

| | | | | |
|---|---|---|---|---|
| 1,779,022 A * | 10/1930 | Wardrop | ..... | A63D 5/06 473/103 |
| 2,194,146 A * | 3/1940 | Kaiserman | ..... | A63D 5/04 473/103 |
| 3,037,771 A * | 6/1962 | Gambino | ..... | A63D 9/00 273/DIG. 7 |

(Continued)

OTHER PUBLICATIONS

Vintage Red and White Plastic Toy Bowling Pins—3.75" with Holes on top, Magnet, https://www.ebay.com/itm/126974801956?msockid=2e2cb5b1269865393af2a2ae2796646d, Mar. 2026.*

(Continued)

*Primary Examiner* — William M Pierce
(74) *Attorney, Agent, or Firm* — Gregory Finch; Finch Paolino, LLC

(57) ABSTRACT

Embodiments of the present disclosure provide for a magnetic bowling game kit. The magnetic bowling game kit comprises a plurality of pins, a game board, and at least one ball. In accordance with a method of gameplay, the plurality of pins are positioned on the game board at a plurality of predetermined locations. In certain embodiments, each pin in the plurality of pins comprises at least one magnet coupled to, or housed within, a bottom surface of the pin. The game board may comprise a plurality of ferrous metal components embedded in the game board at the plurality of predetermined locations. The plurality of pins may be interfaced with the surface of the game board via the magnetic attractive force between the at least one magnet and the plurality of ferrous metal components.

16 Claims, 10 Drawing Sheets

(56) References Cited

U.S. PATENT DOCUMENTS 3,073,597 A * 1/1963 Ernst ..... A63D 9/00 473/119
3,191,935 A * 6/1965 Uecker ..... A63D 5/04 473/118
3,201,124 A * 8/1965 Halip ..... A63D 9/00 273/DIG. 12
3,237,945 A * 3/1966 Sampson ..... A63D 9/00 473/123
3,332,685 A * 7/1967 Halip ..... A63D 9/00 473/119
3,463,490 A * 8/1969 Marcilli ..... A63D 3/00 473/116
3,463,491 A * 8/1969 Shaw ..... A63D 5/04 335/206
3,572,710 A * 3/1971 Negrini ..... A63D 9/00 473/119
3,764,136 A * 10/1973 Breslow ..... A63D 3/00 473/107
5,660,596 A * 8/1997 Rochefort ..... A63D 5/08 473/118
5,888,144 A * 3/1999 Jager ..... B29C 66/1162 473/118
6,846,122 B1 * 1/2005 Liao ..... B43K 8/06 401/131
10,328,323 B2 * 6/2019 Florentino ..... A63B 67/06
2010/0087264 A1 * 4/2010 Suzuki ..... A63D 9/00 264/250
2011/0312432 A1 * 12/2011 Fu ..... A63D 3/00 273/108.1
2018/0264336 A1 * 9/2018 Florentino ..... A63B 71/0036
2023/0041496 A1 * 2/2023 Hutt ..... A63D 3/00
2024/0335731 A1 * 10/2024 Huggins ..... A63D 1/04
2026/0069949 A1 * 3/2026 Meredith ..... A63B 67/08

OTHER PUBLICATIONS

MagnaRack Bowling, includes 10 Magnetic Bowling Pins, 2 Balls, Bowling Mat, Carry Bag, Great Toy Gift, Early Education, Indoor & Outdoor Games, Toddler, Child, Boys & Girls, https://www.amazon.com, Apr. 12, 2022.*

* cited by examiner

MAGNETIC BOWLING GAME

CROSS-REFERENCE TO RELATED APPLICATIONS

The present application claims the benefit of and priority to U.S. provisional application No. 63/458,404, entitled "APPARATUSES AND METHODS OF PLAY FOR RECREATIONAL OUTDOOR GAMES" and having a filing date of Apr. 10, 2023, and U.S. provisional application No. 63/458,406 entitled "APPARATUSES AND METHODS OF PLAY FOR RECREATIONAL OUTDOOR GAMES" and having a filing date of Apr. 10, 2023; the entireties of which are incorporated herein at least by virtue of this reference.

FIELD

The present disclosure relates to the field of outdoor games; in particular, a magnetic bowling game kit and apparatuses associated therewith.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain aspects of the present disclosure provide for a gameplay apparatus comprising a body portion comprising a lower surface; a bottom portion selectively coupled to the lower surface of the body portion, wherein the bottom portion comprises a flat bottom surface, and wherein the bottom portion comprises an interior area; and a magnet housed in the interior area of the bottom portion, wherein the bottom portion is configured to retain the magnet in the interior area of the bottom portion when the bottom portion is selectively coupled to the lower surface of the body portion, wherein the apparatus is configured to stand upright via the flat bottom surface when the bottom portion is selectively coupled to the lower surface of the body portion.

In accordance with certain embodiments of the gameplay apparatus, the bottom portion may comprise an aperture extending through the flat bottom surface. The aperture may be configured such that the magnet is at least partially exposed through the aperture. In certain embodiments, the body portion may comprise a stem portion extending from the lower surface of the body portion. In said embodiments, the magnet may be disposed around a circumference of the stem portion. In certain embodiments, the bottom portion of the gameplay apparatus may be configured to retain the magnet on the stem portion of the body portion when the bottom portion is selectively coupled to the lower surface of the body portion.

Further aspects of the present disclosure provide for a game kit comprising at least one pin apparatus comprising an elongated body having a flat bottom surface and a magnet coupled to a portion of the at least one pin apparatus adjacent to the flat bottom surface; and a game board comprising a plurality of ferrous metal components located at a plurality of spaced apart locations on the game board, wherein the at least one pin apparatus is configured to be magnetically interfaced with the plurality of ferrous metal components via the magnet, wherein the at least one pin apparatus is configured to stand upright when the at least one pin apparatus is magnetically interfaced with the plurality of ferrous metal components via the magnet.

In accordance with certain embodiments of the gameplay kit, the magnet may be housed in an interior area of the at least one pin apparatus (e.g., adjacent to the flat bottom surface). In certain embodiments, the plurality of ferrous metal components may be contained within an interior area of the gameboard. In accordance with certain gameplay aspects of the present disclosure, the at least one pin apparatus is configured to fall over when struck with a ball. In certain embodiments, the flat bottom surface of the at least one pin apparatus comprises an aperture extending therethrough. In said embodiments, at least a portion of the magnet may be exposed via the aperture. In certain embodiments, the at least one pin apparatus further comprises a bottom portion selectively coupled to the elongated body, wherein the bottom portion comprises the flat bottom surface. In said embodiments, the magnet may be housed in an interior area of the bottom portion.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The apparatus and method of the present disclosure may be better understood from the following illustrative description with reference to the following drawings in which.

DETAILED DESCRIPTION

Figure 1:
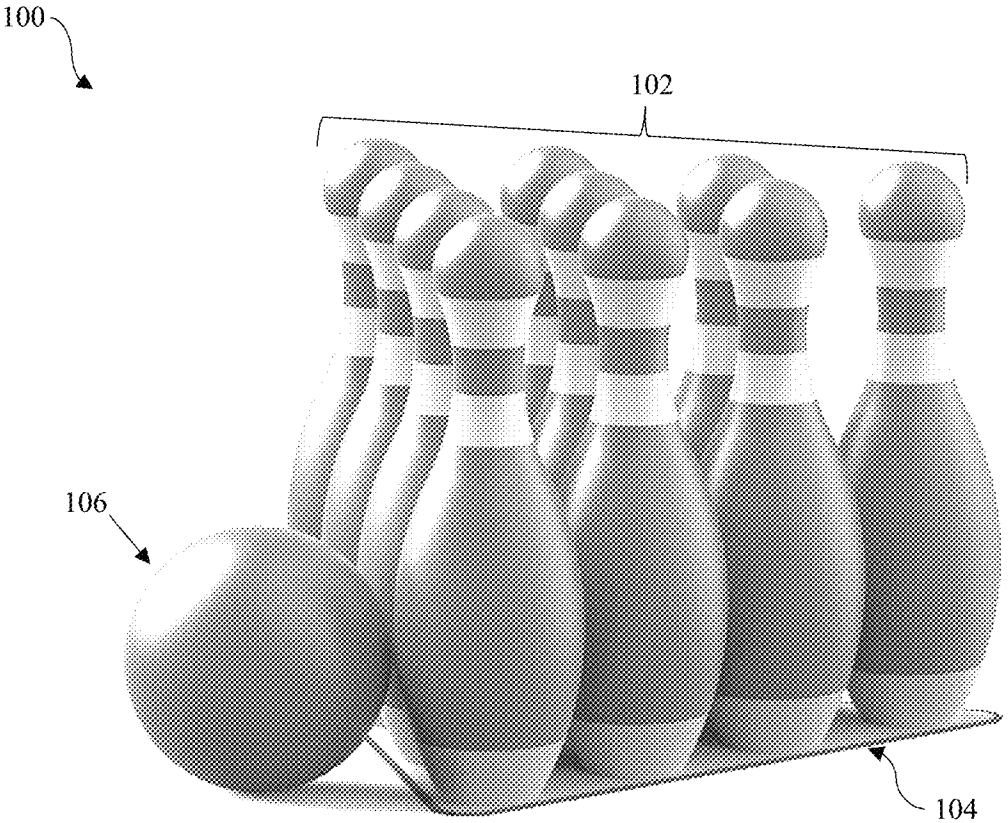
FIG. 1 is a perspective view of a magnetic bowling game kit, in accordance with certain aspects of the present disclosure.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout. All definitions, as defined and used herein, should be understood to control over dictionary definitions, definitions in documents incorporated by reference, and/or ordinary meanings of the defined terms.

Following below are more detailed descriptions of various concepts related to, and embodiments of, inventive method, kit and apparatuses for a magnetic bowling game kit.

It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes. The present disclosure should in no way be limited to the exemplary implementation and techniques illustrated in the drawings and described below.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both of the endpoint limits, ranges excluding either or both of those included endpoints are also included in the scope of the invention.

As used herein, "exemplary" means serving as an example or illustration and does not necessarily denote ideal or best.

As used herein, the term "includes" means includes but is not limited to, the term "including" means including but not limited to. The term "based on" means based at least in part on.

As used herein, the term "interface" refers to any shared boundary across which two or more separate components of a computer system may exchange information. The exchange can be between software, computer hardware, peripheral devices, humans, and combinations thereof. The term "interface" may be further defined as any shared boundary or connection between two dissimilar objects, devices or systems through which information or power is passed and/or a mechanical, functional and/or operational relationship is established and/or accomplished. Such shared boundary or connection may be physical, electrical, logical and/or combinations thereof.

Turning now descriptively to the drawings, in which similar reference characters denote similar elements throughout the several views, FIG. 1 depicts a perspective view of a magnetic bowling game kit 100. In accordance with certain aspects of the present disclosure, kit 100 comprises a plurality of pins 102, a game board 104, and at least one ball 106. In accordance with a method of gameplay for kit 100, the plurality of pins 102 are positioned on game board 104 at a plurality of predetermined locations. A user may throw or roll ball 106 at the plurality of pins 102 (e.g., from a specified distance) with the objective of knocking down the plurality of pins 102 from game board 104. In accordance with certain aspects of the present disclosure, each pin in the plurality of pins 102 comprises at least one magnet coupled to, or housed within, a bottom surface of the pin. Game board 104 may comprise a plurality of ferrous metal components embedded in game board 104 at the plurality of predetermined locations. In accordance with certain aspects of the present disclosure, the plurality of pins 102 are interfaced with the surface of game board 104 via the magnetic attractive force between the at least one magnet and the plurality of ferrous metal components. In accordance with certain aspects of the present disclosure, the magnetic interface between the plurality of pins 102 and the surface of game board 104 enables a user to securely setup the plurality of pins 102 on an uneven surface, such as a lawn or a beach, for the purpose of gameplay.

Figure 2:
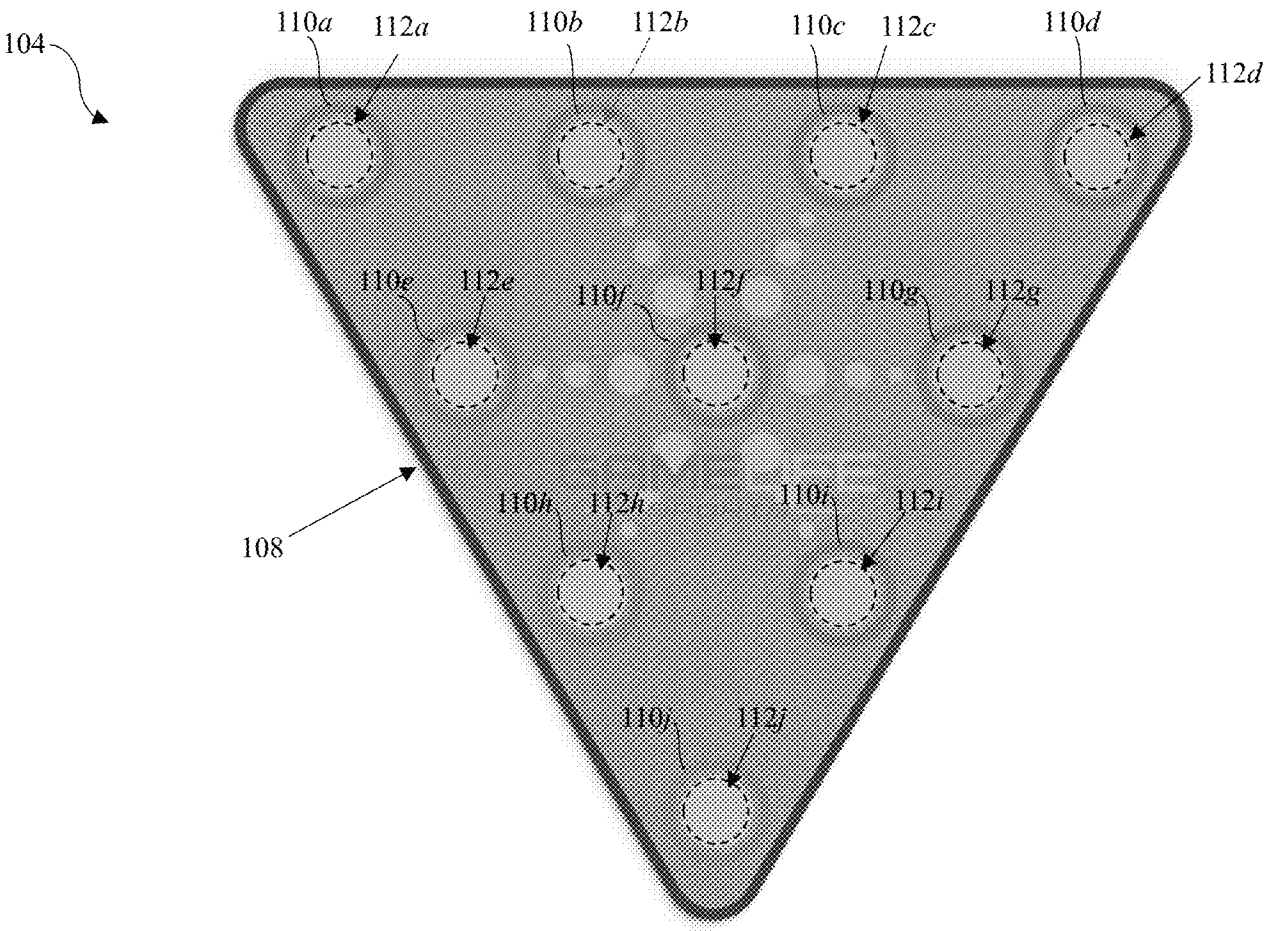
FIG. 2 is a top plan view of a game board for the magnetic bowling game, in accordance with certain aspects of the present disclosure.
Figure 3:
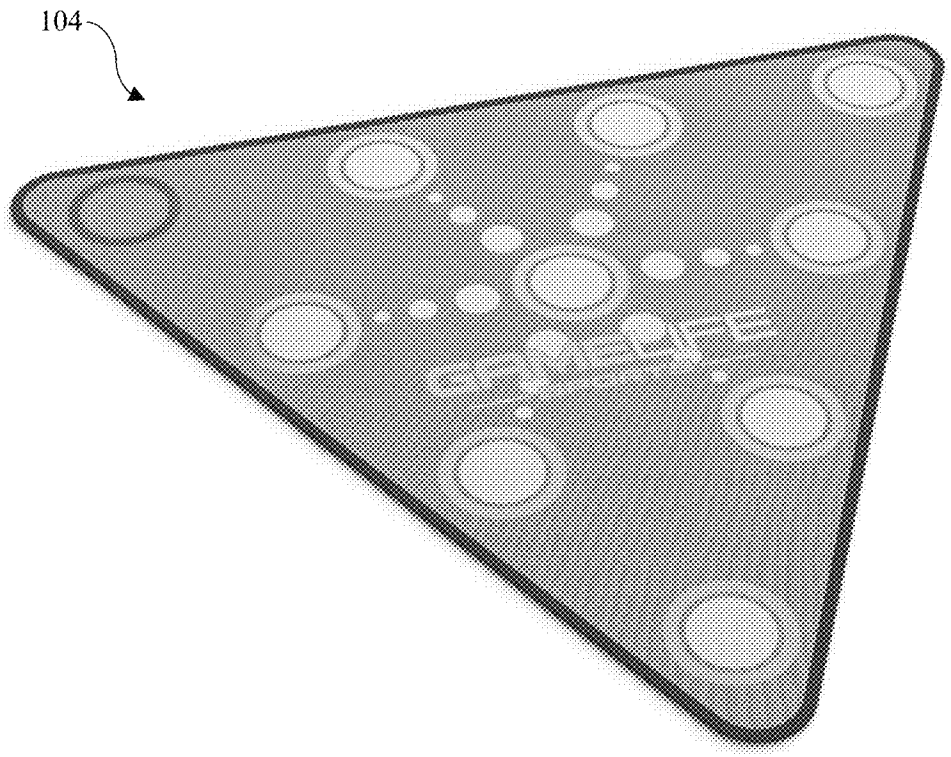
FIG. 3 is an isometric view of a game board for the magnetic bowling game, in accordance with certain aspects of the present disclosure.

FIG. 2 is a top plan view of game board 104 for the magnetic bowling game. FIG. 3 depicts an isometric view of game board 104. In accordance with certain aspects of the present disclosure, game board 104 may comprise a plurality of locations 110*a-j* at which the plurality of pins 102 (as shown in FIG. 1) are intended to be positioned for the purposes of gameplay. As shown in FIG. 2, the plurality of locations 110*a-j* may be denoted by a plurality of markings (e.g., a circle or other graphical indication). In accordance with certain embodiments, game board 104 comprises a plurality of ferrous metal components 112*a-j* that are embedded in an interior area of game board 104. The plurality of ferrous metal components 112*a-j* may comprise a plurality of ferrous metal disks. Game board 104 may be constructed from a fabric material that enables game board 104 to be folded for storage. In said embodiments, the plurality of ferrous metal components 112*a-j* may be sewn into the fabric material (e.g., between an upper fabric surface and a lower fabric surface) to retain the plurality of ferrous metal components 112*a-j* at the plurality of locations 110*a-j*.

Figure 4:
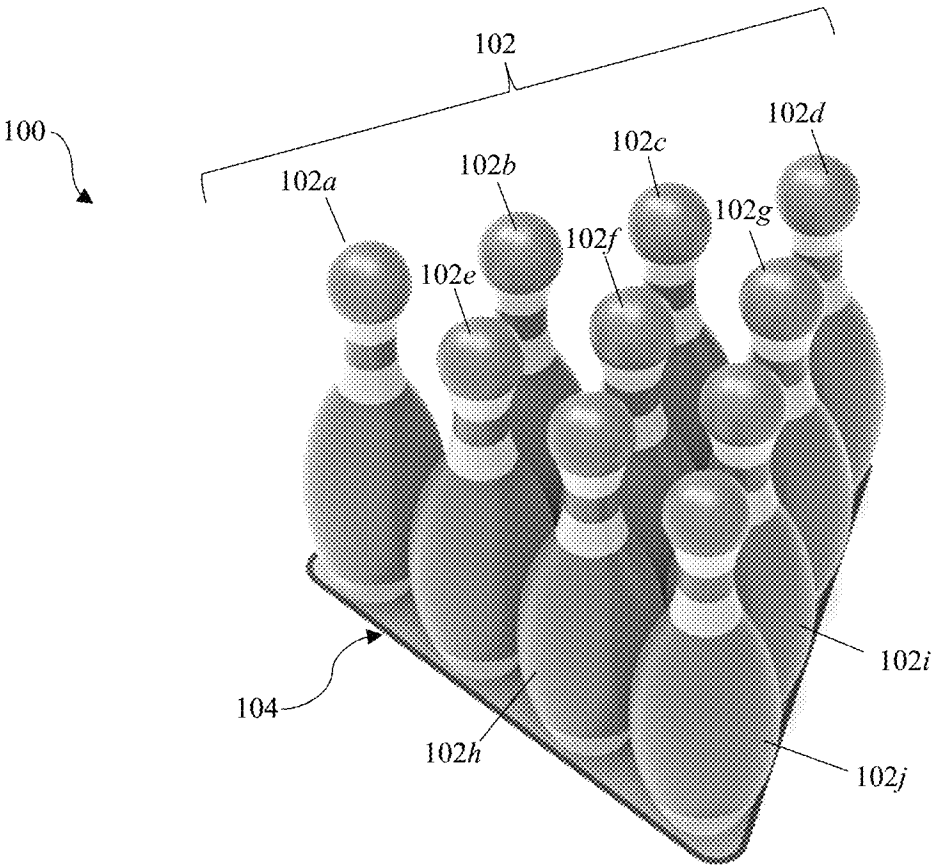
FIG. 4 is an isometric view of a magnetic bowling game kit, in accordance with certain aspects of the present disclosure.
Figure 5:
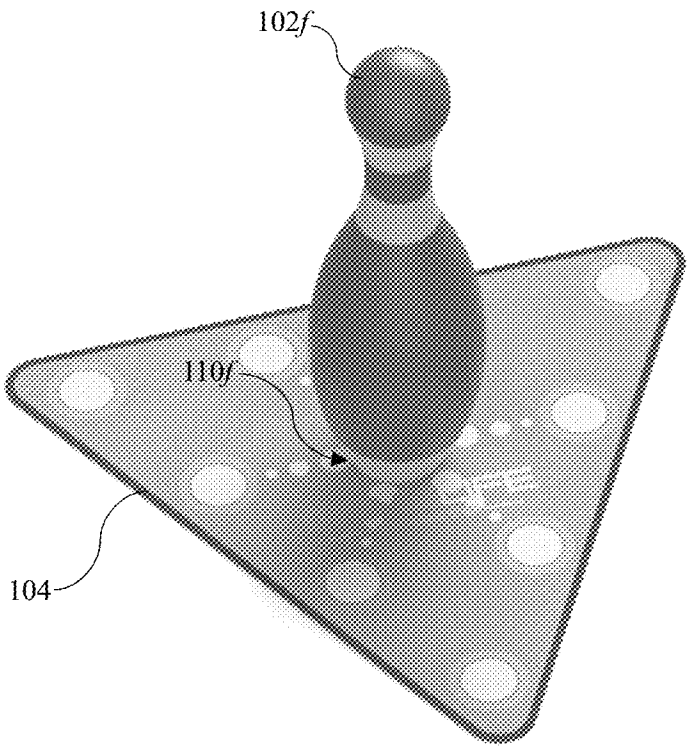
FIG. 5 is an isometric view of a magnetic bowling pin apparatus and a game board for the magnetic bowling game, in accordance with certain aspects of the present disclosure.

FIG. 4 illustrates an isometric view of magnetic bowling game kit 100. In accordance with certain aspects of the present disclosure, the plurality of pins 102 comprises pins 102*a-j*. The plurality of pins 102 may be positioned on gameboard 104 at a plurality of specified locations for the purpose of gameplay. For example, as shown in FIG. 5, pin 102*f* may be positioned at location 110*f*.

Figure 6:
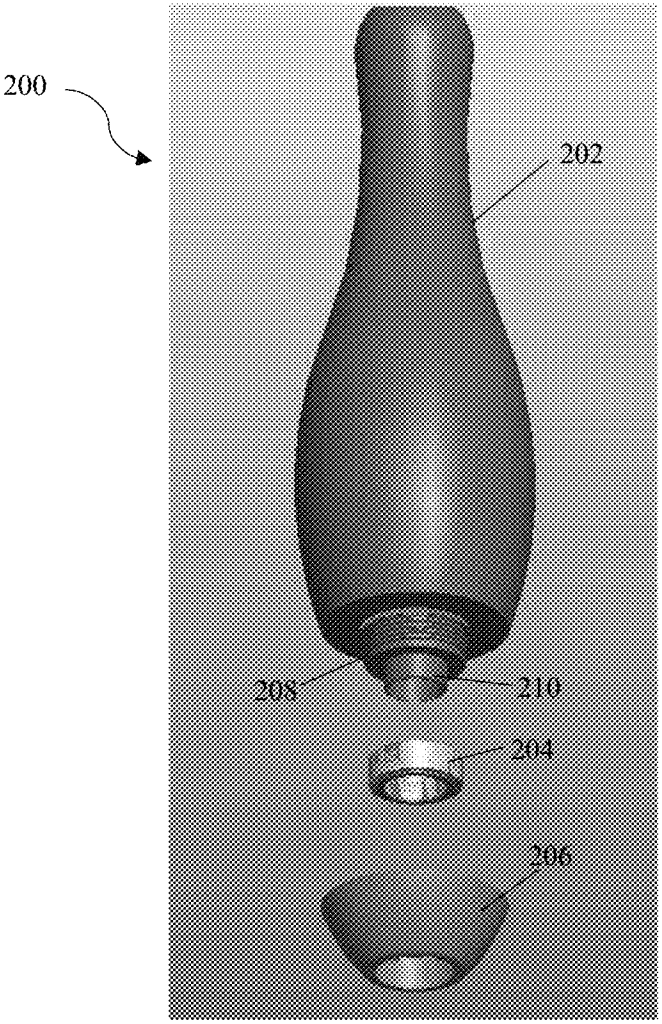
FIG. 6 is an exploded view of a magnetic bowling pin apparatus, in accordance with certain aspects of the present disclosure.
Figure 7:
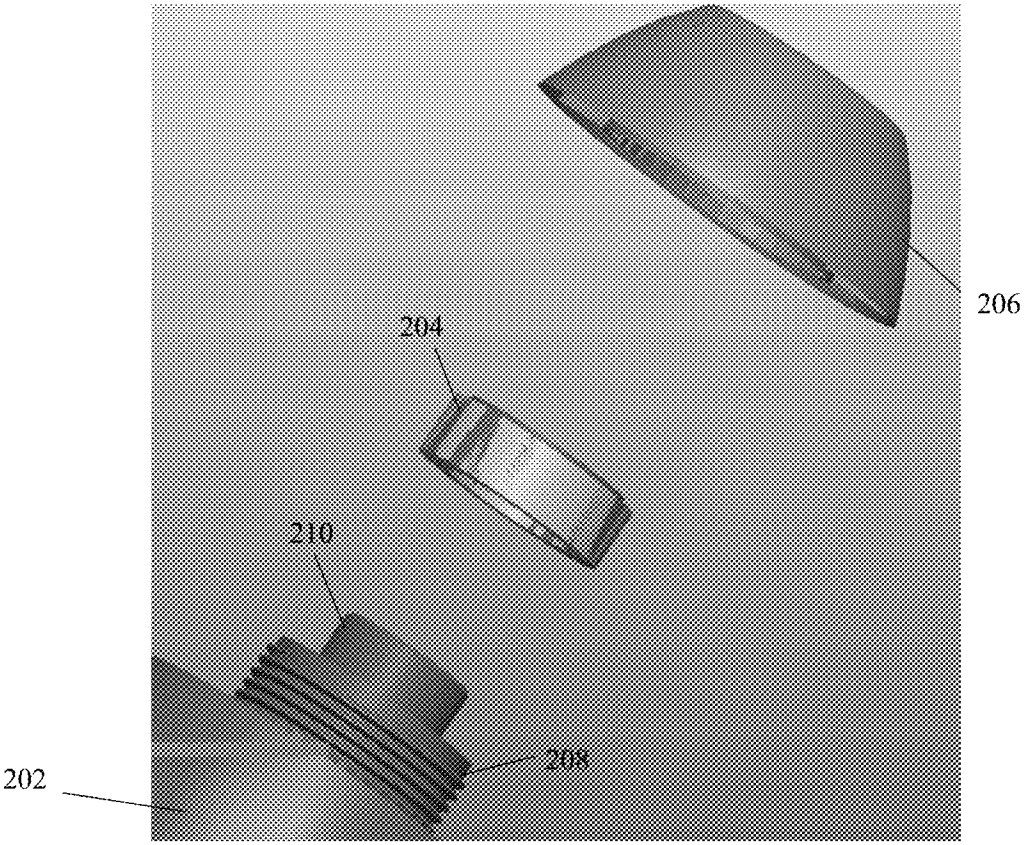
FIG. 7 is a magnified exploded view of the magnetic bowling pin apparatus, in accordance with certain aspects of the present disclosure.
Figure 9:
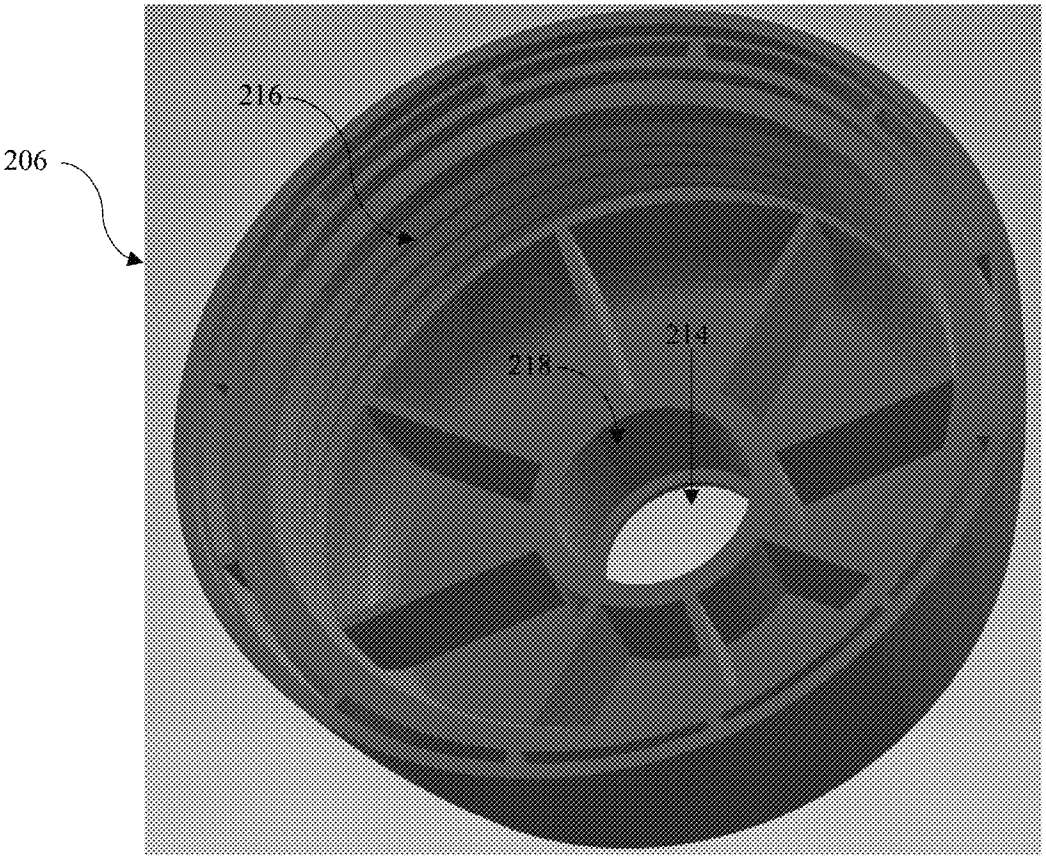
FIG. 9 is a perspective view of an end cap for the magnetic bowling pin apparatus, in accordance with certain aspects of the present disclosure.

Referring now to FIGS. 6-7, exploded views of a magnetic bowling pin apparatus 200 are shown. In accordance with certain aspects of the present disclosure, apparatus 200 comprises an embodiment of a pin in the plurality of pins 102. In accordance with certain aspects of the present disclosure, apparatus 200 comprises a body portion 202, a magnet 204, and a base portion 206. Base portion 206 may comprise a flat bottom surface of apparatus 200. In certain embodiments, apparatus 200 comprises a threaded portion 208 extending from a bottom surface of body portion 202. Apparatus 200 may further comprise a stem portion 210 extending from the threaded portion 208. Magnet 204 may comprise a ring magnet comprising an inner circumference and an outer circumference. In accordance with certain embodiments, the inner circumference of magnet 204 may be configured to interface with the stem portion 210. As shown in FIG. 9, base portion 206 may comprise an internal area 218. Internal area 218 may comprise a circular area configured to receive and retain magnet 204.

Figure 8:
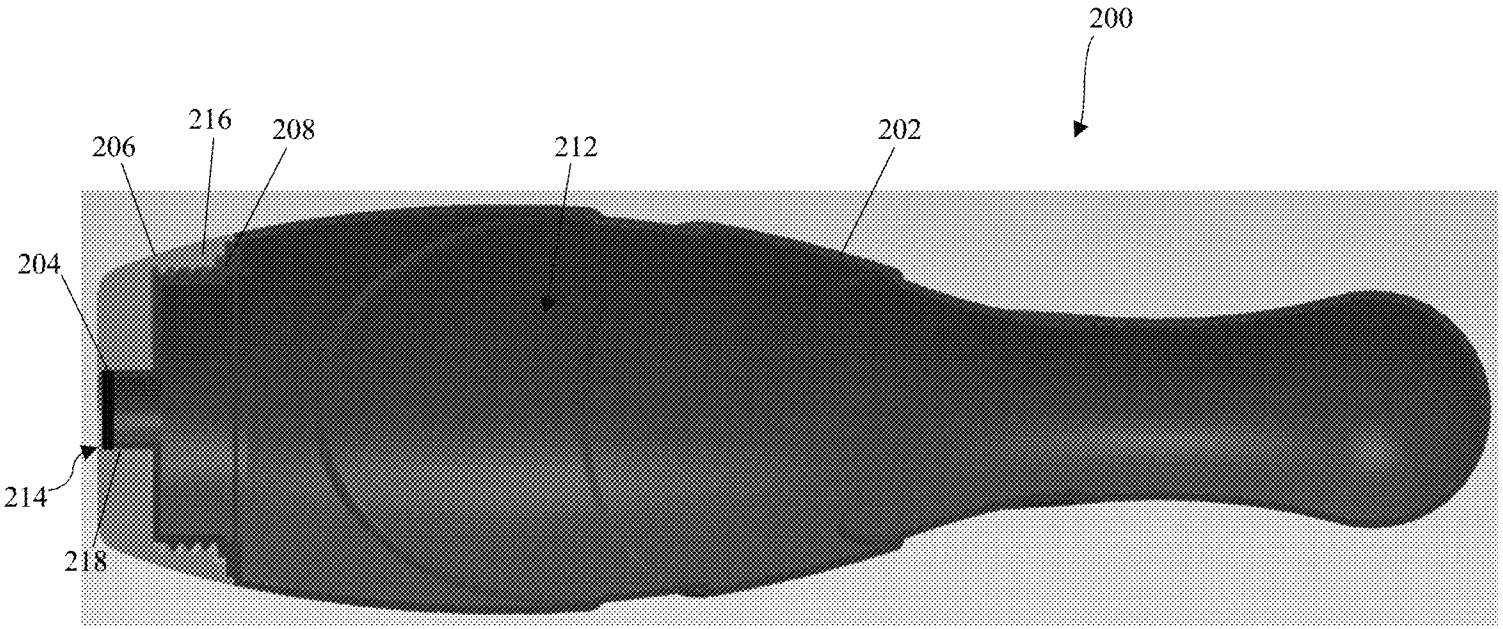
FIG. 8 is a cross-sectional view of the magnetic bowling pin apparatus, in accordance with certain aspects of the present disclosure.

Referring now to FIG. 8, a cross-sectional view of magnetic bowling pin apparatus 200 is shown. In accordance with certain aspects of the present disclosure, body portion 202 may comprise a hollow internal area 212. Body portion 202 may be constructed from blow molded plastic. In accordance with certain aspects of the present disclosure, base portion 206 may be selectively interfaced with body portion 202 via a mechanical interface between the body threaded portion 208 and a threaded portion 216 of base portion 206. Base portion 206 may be selectively coupled to body portion 202 via one or more alternative mechanical interfaces. In certain embodiments, base portion 206 may be permanently coupled to body portion 202 via an adhesive bond. As shown in FIG. 8, magnet 204 may be retained in internal area 218 via the interface between base portion 206 and body portion 202.

Figure 10:
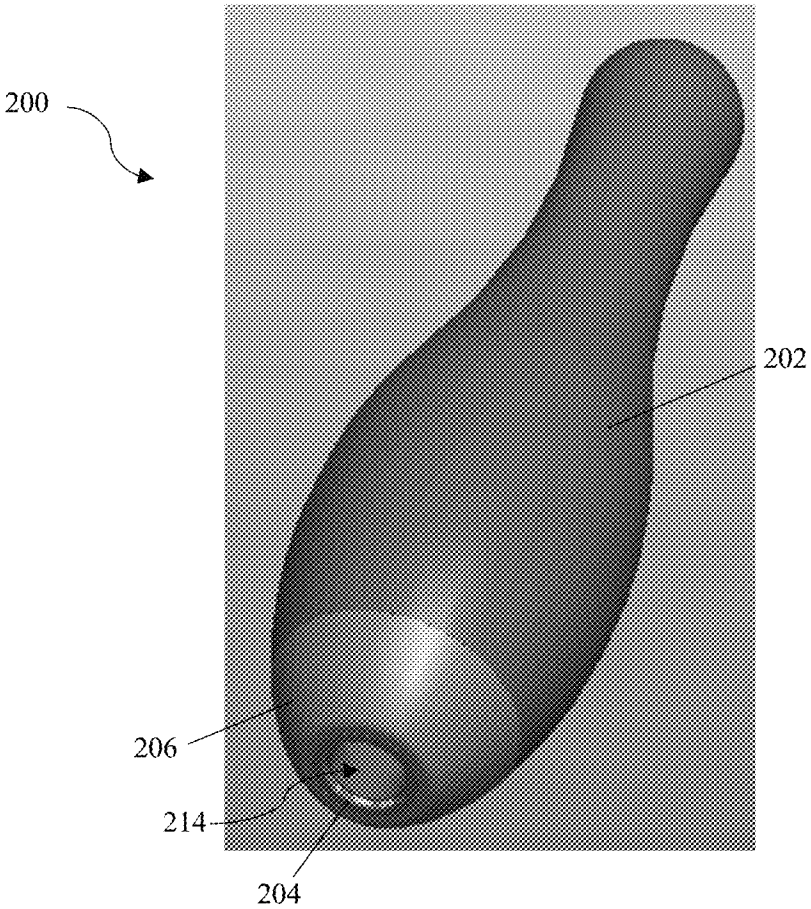
FIG. 10 is a perspective view of the magnetic bowling pin apparatus, in accordance with certain aspects of the present disclosure.

As further illustrated in FIGS. 9-10, base portion 206 may comprise an aperture 214. As shown in FIG. 10, aperture 214 may expose an internal area of body portion 202. In accordance with certain embodiments, aperture 214 may expose at least a portion of magnet 204. In accordance with certain embodiments, aperture 214 is configured to enhance the magnetic interface between apparatus 200 and the gameboard surface.

In accordance with an exemplary method of gameplay, a user may utilize kit 100 (e.g., as shown in FIG. 1B) to play a game according to substantially the same rules as traditional bowling. A game can be played with any number of players. In accordance with certain methods of play, the players stand at a preset distance from the pins chosen at the beginning of the game depending on the skill level of the players. If there is a significant difference in skill levels of various players, players of higher skill levels may choose to stand further back than other players as a "handicap" to level the playing field. Each game may comprise ten frames. Pins are reset on the gameboard (e.g., via the magnetic interface between the pins and the gameboard surface) after each player's turn is over. In the first nine frames, each player takes turns bowling one or two balls, as follows. If the player knocks down nine or fewer pins with their first ball, the pins shall remain in place and the player bowls a second ball. If the player knocks down all ten pins with their first ball, their turn is over. On the tenth frame, each player takes turns bowling two or three balls, as follows. If the player knocks down nine or fewer pins with their first ball, they bowl a second ball. If the player does not knock down all remaining pins with their second ball to complete a spare, their turn is over. If the player knocks down all remaining pins with their second ball to complete a spare, all pins are reset and they bowl a third ball, then their turn is over. If the player knocks down all ten pins with their first ball, all pins are reset, and they bowl a second ball. If the player knocks down nine or fewer pins with their second ball, pins shall remain in place, and they bowl a third ball. If the player knocks down all ten pins with their second ball, all pins are reset and they bowl a third ball, then their turn is over. Points are tallied at the end of each game and the player with the highest point total wins.

The terminology used herein is for describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including,", and variants thereof, when used herein, specify the presence of stated features, steps, operations, elements, and/or components, but do not preclude the presence or addition of one or more other features, steps, operations, elements, components, and/or groups thereof. As used herein, "exemplary" means serving as an example or illustration and does not necessarily denote ideal or best.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top, "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments. Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. An apparatus comprising:

a body portion comprising a lower surface;

a bottom portion selectively coupled to the lower surface of the body portion, wherein the bottom portion comprises a flat bottom surface, and wherein the bottom portion comprises an interior area; and a magnet housed in the interior area of the bottom portion, wherein the bottom portion is configured to retain the magnet in the interior area of the bottom portion when the bottom portion is selectively coupled to the lower surface of the body portion, wherein the apparatus is configured to stand upright via the flat bottom surface when the bottom portion is selectively coupled to the lower surface of the body portion, wherein the body portion comprises a stem portion extending from the lower surface of the body portion, wherein the magnet is disposed around a circumference of the stem portion.

2. The apparatus of claim 1 wherein the bottom portion comprises an aperture extending through the flat bottom surface.

3. The apparatus of claim 2 wherein the aperture is configured such that the magnet is at least partially exposed through the aperture.

4. The apparatus of claim 1 wherein the bottom portion is configured to retain the magnet on the stem portion of the body portion.

5. A game kit comprising:

at least one pin apparatus comprising:

a body portion comprising a lower surface;

a bottom portion selectively coupled to the lower surface of the body portion, wherein the bottom portion comprises an interior area; and a magnet housed in the interior area of the bottom portion, wherein the body portion comprises a stem portion extending from the lower surface of the body portion, wherein the magnet is disposed around a circumference of the stem portion; and a game board comprising a plurality of ferrous metal components located at a plurality of spaced apart locations on the game board, wherein the at least one pin apparatus is configured to be magnetically interfaced with the plurality of ferrous metal components via the magnet, wherein the at least one pin apparatus is configured to stand upright when the at least one pin apparatus is magnetically interfaced with the plurality of ferrous metal components via the magnet.

6. The game kit of claim 5 wherein the plurality of ferrous metal components are contained within an interior area of the game board.

7. The game kit of claim 5 wherein the at least one pin apparatus is configured to fall over when struck with a ball.

8. The game kit of claim 5 wherein the magnet comprises a ring magnet.

9. The game kit of claim 5 wherein the plurality of ferrous metal components comprise a plurality of ferrous metal disks.

10. The game kit of claim 5 wherein the game board comprises a fabric material configured to be folded for storage.

11. The game kit of claim 10 wherein the plurality of ferrous metal components are sewn into the fabric material.

12. The game kit of claim 5 further comprising a plurality of pin apparatuses.

13. The game kit of claim 5 further comprising at least one ball.

14. The game kit of claim 5 wherein the plurality of spaced apart locations are denoted by a plurality of markings on the game board.

15. The apparatus of claim 1 wherein the magnet comprises a ring magnet.

16. The apparatus of claim 1 wherein the bottom portion is permanently coupled to the lower surface of the body portion via an adhesive bond.

* * * * *